US007066465B2

(12) United States Patent
Daines

(10) Patent No.: US 7,066,465 B2
(45) Date of Patent: Jun. 27, 2006

(54) SIDE BET FOR BLACKJACK STYLE CARD GAME

(75) Inventor: Shirley Daines, Red Deer (CA)

(73) Assignee: Canadian 21 Stock Ltd., Alberta (CA)

( * ) Notice: Subject to any disclaimer, the term of this patent is extended or adjusted under 35 U.S.C. 154(b) by 0 days.

(21) Appl. No.: 10/604,658

(22) Filed: Aug. 7, 2003

(65) Prior Publication Data

US 2005/0029743 A1 Feb. 10, 2005

(51) Int. Cl.
*A63F 1/00* (2006.01)

(52) U.S. Cl. ..... 273/292; 273/274; 273/303

(58) Field of Classification Search ..... 273/292, 273/138 A, 303, 274
See application file for complete search history.

(56) References Cited

U.S. PATENT DOCUMENTS

| | | | | | |
|---|---|---|---|---|---|
| 3,796,433 | A | | 3/1974 | Fraley et al. | 273/138 |
| 3,962,800 | A | * | 6/1976 | Feldheim | 434/129 |
| 4,651,997 | A | | 3/1987 | Wood | 273/274 |
| 4,926,327 | A | | 5/1990 | Sidley | 364/412 |
| 5,154,429 | A | | 10/1992 | LeVasseur | 273/292 |
| 5,174,579 | A | | 12/1992 | Griffiths | 273/292 |
| 5,224,706 | A | * | 7/1993 | Bridgeman et al. | 463/13 |
| 5,257,789 | A | | 11/1993 | LeVasseur | 273/309 |
| 5,257,810 | A | | 11/1993 | Schorr et al. | 273/292 |
| 5,265,882 | A | | 11/1993 | Malek | 273/292 |
| 5,275,416 | A | | 1/1994 | Schorr et al. | 273/292 |
| 5,280,915 | A | | 1/1994 | Groussman | 273/292 |
| 5,288,082 | A | | 2/1994 | Marquez | 273/292 |
| 5,320,356 | A | | 6/1994 | Cauda | 273/292 |
| 5,328,189 | A | | 7/1994 | Malek | 273/292 |
| 5,377,993 | A | | 1/1995 | Josephs | 273/292 |
| 5,380,012 | A | | 1/1995 | Jones et al. | 273/292 |
| 5,382,025 | A | * | 1/1995 | Sklansky et al. | 273/292 |
| 5,395,120 | A | | 3/1995 | Malek | 273/292 |
| 5,407,209 | A | | 4/1995 | Prerost | 273/292 |
| 5,413,353 | A | | 5/1995 | Demarest | 273/292 |
| 5,531,448 | A | * | 7/1996 | Moody | 273/292 |
| 5,549,301 | A | | 8/1996 | Gerrard | 273/305 |
| 5,577,731 | A | | 11/1996 | Jones | 273/292 |
| 5,603,499 | A | | 2/1997 | Jagosz | 273/148 |
| 5,628,514 | A | | 5/1997 | Nguyen et al. | 273/292 |
| 5,632,485 | A | | 5/1997 | Woodland | 273/292 |
| 5,632,487 | A | | 5/1997 | Nguyen | 273/292 |
| 5,653,444 | A | * | 8/1997 | Dahl | 273/274 |
| 5,673,917 | A | | 10/1997 | Vancura | 273/292 |
| 5,685,774 | A | * | 11/1997 | Webb | 463/13 |
| 5,735,524 | A | | 4/1998 | Wisted | 273/292 |
| 5,743,532 | A | | 4/1998 | Lafferty | 273/292 |
| 5,799,946 | A | | 9/1998 | Groussman | 273/292 |
| 5,816,575 | A | | 10/1998 | Keller | 273/292 |
| 5,823,536 | A | | 10/1998 | Flasch | 273/292 |
| RE35,968 | E | | 11/1998 | Prerost | 273/292 |
| 5,868,392 | A | | 2/1999 | Kraft | 273/292 |
| 5,868,619 | A | | 2/1999 | Wood et al. | 463/13 |
| 5,873,572 | A | | 2/1999 | Huynh | 273/292 |
| 5,934,675 | A | | 8/1999 | Handelman et al. | 273/292 |
| 5,944,314 | A | * | 8/1999 | Stavinsky | 273/292 |
| 5,951,012 | A | | 9/1999 | Feola | 273/292 |
| 5,954,336 | A | | 9/1999 | Goossens et al. | 273/309 |
| 6,000,699 | A | | 12/1999 | Long | 273/292 |
| 6,012,719 | A | * | 1/2000 | Webb | 273/292 |
| 6,056,641 | A | * | 5/2000 | Webb | 463/13 |
| 6,070,873 | A | * | 6/2000 | Perkins | 273/292 |
| 6,095,525 | A | | 8/2000 | Terminel | 273/292 |
| 6,102,403 | A | | 8/2000 | Kaufman | 273/292 |
| 6,135,453 | A | | 10/2000 | Srichayaporn | 273/292 |
| 6,170,828 | B1 | | 1/2001 | Mostashari | 273/292 |
| 6,234,485 | B1 | * | 5/2001 | Perkins | 273/292 |
| 6,293,551 | B1 | | 9/2001 | Webb | 273/292 |
| 6,305,690 | B1 | | 10/2001 | Webb | 273/292 |
| 6,334,614 | B1 | * | 1/2002 | Breeding | 273/292 |
| 6,336,857 | B1 | * | 1/2002 | McBride | 463/12 |
| 6,336,859 | B1 | * | 1/2002 | Jones et al. | 463/13 |
| 6,371,485 | B1 | * | 4/2002 | Daines | 273/303 |
| 6,371,867 | B1 | * | 4/2002 | Webb | 473/292 |
| 6,406,024 | B1 | * | 6/2002 | Perkins | 273/292 |
| 6,422,565 | B1 | * | 7/2002 | Daines | 273/292 |
| 6,481,719 | B1 | * | 11/2002 | Webb | 273/292 |
| 6,511,070 | B1 | * | 1/2003 | Daines | 273/292 |
| 6,514,140 | B1 | * | 2/2003 | Storch | 463/25 |
| 6,523,831 | B1 | | 2/2003 | Webb | |
| 6,536,769 | B1 | * | 3/2003 | Palacios et al. | 273/292 |
| 2001/0035610 | A1 | | 11/2001 | Webb | |
| 2002/0000693 | A1 | | 1/2002 | Webb | |
| 2002/0045471 | A1 | * | 4/2002 | Cranford | 463/12 |
| 2002/0074724 | A1 | * | 6/2002 | Webb | 273/274 |
| 2003/0030216 | A1 | * | 2/2003 | Endoso | 273/274 |
| 2003/0087694 | A1 | * | 5/2003 | Storch | 463/25 |

(Continued)

OTHER PUBLICATIONS

Scarne's Encyclopedia of Games, John Scarne, Harper & Row, 1973—pp. 277-290.

(Continued)

*Primary Examiner*—Eugene Kim
*Assistant Examiner*—Dolores R. Collins
(74) *Attorney, Agent, or Firm*—Muskin & Cusick

(57) ABSTRACT

A side bet which may be implemented in any blackjack-style card game method provides an opportunity to win a bet based on combinations of three cards which may be the player's first two cards and the dealer's first card. The player may win the side bet with certain combinations of cards having different winning payouts.

13 Claims, No Drawings

U.S. PATENT DOCUMENTS

| | | | | |
|---|---|---|---|---|
| 2004/0070146 | A1* | 4/2004 | Snow | 273/292 |
| 2004/0080110 | A1 | 4/2004 | Webb | |
| 2004/0121831 | A1* | 6/2004 | Perkins | 463/13 |
| 2004/0124585 | A1* | 7/2004 | Daines | 273/292 |

OTHER PUBLICATIONS

Shackleford, "Blackjack Appendix 8", http://wizardofodds.com/games/blackjack/bjapx8.html, published Sep. 27, 2002.

* cited by examiner

SIDE BET FOR BLACKJACK STYLE CARD GAME

BACKGROUND OF INVENTION

This invention relates to a method of playing a card game based on the well-known game of blackjack.

SUMMARY OF INVENTION

In one aspect, the invention may comprise a method of playing blackjack or 21, comprising the steps of:

(a) dealing two initial cards to a player and a single initial card to a dealer (the "three initial cards");

(b) allowing the player to place a side bet;

(c) paying or collecting the side bet in accordance with a pre-established set of rules which cover all possible combinations of the three initial cards; and (d) continuing with the blackjack game.

In another aspect, the invention comprises an improvement to a conventional or variant game of blackjack, wherein the improvement comprises the steps of:

(a) allowing the player to place a side bet;

(b) paying or collecting the side bet in accordance with a pre-established set of rules which cover all possible combinations of the three initial cards.

DETAILED DESCRIPTION

When describing the present invention, all terms not defined herein have their common art-recognized meanings. The term "live casino game" is intended to encompass a game in which the house acts as the banker, the house collecting all losing wagers and paying all winning wagers. The term "wager" is used synonymously with the term "bet". The dealer is employed by the house and each player plays exclusively against the house.

The method of the present invention is an optional side bet which may be provided in conjunction with conventional blackjack, or any variation of blackjack. The side bet is based on combinations of three cards, which in one embodiment, are the first two cards dealt to a player and the dealer's first card. References to "the three cards" or "the three initial cards" herein shall be understood to refer to these cards.

The present invention is intended to be practiced as a live casino game in a casino or gaming house environment where players may wager against the house, but may not be restricted to such an environment. The basic object of blackjack is to achieve a hand of cards close to or equal to 21 without exceeding 21. If a hand exceeds 21, the player or dealer is said to have "bust". The card game method of the present invention may be played with a standard deck of 52 cards, and is preferably played with at least three decks, and is more preferably played with six decks of cards. As is conventionally the case, numerical cards are valued at their face value, face cards count as 10 and aces count as 1 or 11 points.

The dealer plays against each player one at a time. If there are two or more players, they must take turns playing. play begins with each player making a main bet and, optionally, a side bet. The amount of the main bet and the side bet may be any sum allowed by the house. The main bet is won, lost or pushed in accordance with the basic rules of blackjack described above, or the variant rules if the game is a variation of blackjack.

The dealer deals an initial two cards face up to each player and an initial card face up for the dealer. These three cards are used to determine the fate of the side bet. The side bet will be determined and paid or collected before regular blackjack play continues.

The side bet is an optional betting method which introduces elements of other three-card games. For example, the house may recognize winning hands and provide pay-outs based on the three cards being sequential or the same, either suited or not-suited. As is obvious, three same cards of the same suit is only possible in multiple deck games. As well, the house may recognize cases where the initial three card hand equals 19, 20 or 21. Therefore, the side bet is won or lost in accordance with a set of rules which are pre-established by the house. The types of winning hands and payouts provided determine the house edge in the side bet. Those skilled in the art may easily modify the types of winning hands and payouts to increase or decrease the house edge as necessary or desired.

In a particularly preferred embodiment, the winning hands and payouts shown in Table 1 provide a 2.6%–2.8% house edge using multiple decks of cards.

TABLE 1

| Player's Hand | Payoff |
|---|---|
| Suited 7-7-7 | 200–1 |
| Suited 6-7-8 | 100–1 |
| Any Suit 7-7-7 | 50–1 |
| Any Suit 6-7-8 | 30–1 |
| Suited 21 | 15–1 |
| 21 | 3–1 |
| 20 | 2–1 |
| 19 | 2–1 |
| All Others | Loss |

In the event the player qualifies for more than one winning three-card hand, only the highest payout will be paid. For example, if the three initial cards are a suited 7-7-7, then the player will win the 200 to 1 bet, but not the "any suit 7-7-7" payout nor the "suited 21" payout.

In another preferred embodiment, the winning hands and payouts shown in Table 2 provide a 4.83% house edge using multiple decks of cards.

TABLE 2

| Player's Hand | Payoff |
|---|---|
| Suited 7-7-7 | 500–1 |
| Suited 6-7-8 | 150–1 |
| Any Suit 7-7-7 | 100–1 |
| Any Suit 6-7-8 | 30–1 |
| Suited 21 | 20–1 |
| 21 | 2–1 |
| 20 | 2–1 |
| 19 | 2–1 |
| All Others | Loss |

As is apparent to one skilled in the art, the methods disclosed herein may be implemented at a live table game or electronically in an electronic video type gaming device, of the same general type disclosed in U.S. Pat. Nos. 4,948,134; 5,022,653; 5,377,973; 5,374,067; and 5,382,025. In the electronic version, the hand(s) of the player(s) and dealer take the form of video representations of playing cards displayed on a screen, under the control of a microprocessor operating under a suitable program.

As will be apparent to those skilled in the art, various modifications, adaptations and variations of the foregoing specific disclosure can be made without departing from the scope of the invention claimed herein.

What is claimed is:

1. In a method of playing a conventional of variant game of blackjack between a dealer and a player where the player is dealt two initial cards and the dealer is dealt a single initial card, wherein the players two initial cards and the dealers single initial card comprise three initial cards, an improvement comprising the steps of:

(a) allowing the player to place a side bet;

(b) paying or collecting the side bet in accordance with a pre-established set of rules;

(c) and wherein the pre-established set of rules provides a winning side bet for the player where the sum of the three initial cards is greater than or equal to 19, but not greater than 21.

2. The method of claim 1 wherein the game is played with at least three decks and wherein the pre-established set of rules provides a winning side bet for the player in one or more of the following circumstances (a) the three initial cards are sequential and of the same suit; and (b) the three initial cards are the same card and of the same suit.

3. The method of claim 2 wherein the only winning circumstance where the three initial cards are sequential are if the cards are 6, 7 and 8.

4. The method of claim 2 or 3 wherein the only winning circumstance where the three initial cards are the same are if the cards are all 7.

5. A method to player a side bet for a blackjack game, the method comprising:

allowing the player to place a blackjack hand bet and a simultaneous side bet;

dealing two cards to a player and a third card to form a three card hand; and resolving the side bet based on the three card hand, wherein if the three card hand is comprised of three suited sevens, then the player wins a payout of a first amount;

if the three card hand is comprised of three sevens of any suit, then the player wins a payout of a second amount;

if the three card hand is comprised of a suited 6-7-8 then the player wins a payout of a third amount;

if the three card hand is comprised of a 6-7-8 of any suit then the player wins a payout of a fourth amount;

if the three hand is comprised of cards which total 19-21 then the player wins a payout.

6. A method as recited in claim 5, wherein the first amount is higher than the second amount.

7. A method as recited in claim 5, wherein the third amount is higher than the fourth amount.

8. A method as recited in claim 6, wherein the third amount is higher than the fourth amount.

9. A method as recited in claim 8, wherein the first amount is greater than the third amount.

10. A method as recited in claim 9, wherein the second amount is greater than the fourth amount.

11. A method as recited in claim 8, wherein if the three card hand is comprised of cards which total 19–21, then the payout the player wins is less than the first amount and less than the second amount and less than the third amount and less than the fourth amount.

12. A method as recited in claim 9, wherein the three card hand is paid according to the following paytable:

| Player's Hand | Payoff |
|---|---|
| Suited 7-7-7 | 200–1 |
| Suited 6-7-8 | 100–1 |
| Any Suit 7-7-7 | 50–1 |
| Any Suit 6-7-8 | 30–1 |
| Suited 21 | 15–1 |
| 21 | 3–1 |
| 20 | 2–1 |
| 19 | 2–1 |
| All Others | Loss |

13. A method as recited in claim 9, wherein the three card hand is paid according to the following paytable:

| Player's Hand | Payoff |
|---|---|
| Suited 7-7-7 | 500–1 |
| Suited 6-7-8 | 150–1 |
| Any Suit 7-7-7 | 100–1 |
| Any Suit 6-7-8 | 30–1 |
| Suited 21 | 20–1 |
| 21 | 2–1 |
| 20 | 2–1 |
| 19 | 2–1 |
| All Others | Loss |

* * * * *

UNITED STATES PATENT AND TRADEMARK OFFICE

CERTIFICATE OF CORRECTION

PATENT NO. : 7,066,465 B2
APPLICATION NO. : 10/604658
DATED : June 27, 2006
INVENTOR(S) : Shirley Daines et al.

It is certified that error appears in the above-identified patent and that said Letters Patent is hereby corrected as shown below:

Title Page

Item (75) Inventor should read

Shirley Daines, Alberta, Canada; Franklin Daines, Alberta, Canada; Michael Shackelford, Alberta, Canada Signed and Sealed this Fifth Day of February, 2008

JON W. DUDAS
*Director of the United States Patent and Trademark Office*